United States Patent [19]

McCabe

[11] 4,041,570

[45] Aug. 16, 1977

[54] RESETTABLE, HEAT ACTUATABLE FIRE LINK

[76] Inventor: Francis J. McCabe, 239 Hastings Court, Doylestown, Pa. 18901

[21] Appl. No.: 676,483

[22] Filed: Apr. 13, 1976

[51] Int. Cl.[2] ..... E05F 15/20

[52] U.S. Cl. ..... 16/48.5

[58] Field of Search ..... 49/1, 2, 31, 279, 379; 16/48.5, 49, 85, 78, DIG. 10, DIG. 14; 160/1, 6, 2, 5, 7, 8; 24/230

[56] References Cited

U.S. PATENT DOCUMENTS

| | | | |
|---|---|---|---|
| 1,392,002 | 9/1921 | Engle | 49/2 |
| 1,987,330 | 1/1935 | Fischer | 49/2 |
| 3,889,314 | 6/1975 | McCabe | 16/48.5 |
| 3,964,125 | 6/1976 | Tansley | 16/48.5 |

*Primary Examiner*—G. V. Larkin

*Attorney, Agent, or Firm*—Benasutti Associates, Ltd.

[57] ABSTRACT

A resettable fire link is described comprising a releasable member, gripping means for engaging said releasable member in the normal position and for releasing said releasable member in the activated position. Said gripping means comprises heat responsive means for causing said gripping means to move to the normal position in response to an ambient temperature and for causing said gripping means to move to the activated position in response to a preselected increase in said ambient temperature. Mechanical activation means are also provided for movement from a first withdrawn to a second extended position. In said first withdrawn position, the mechanical activation means allows said gripping means to move freely between its normal and said activated position, as aforesaid. The mechanical activation means also may independently cause said gripping means to move to the activated position. As a result, a novel heat and/or remote mechanically activated fire link is provided which is ideally suited for disposition in a "dirty" environment such as might be found in a poorly filtered ventilating system.

The fire link of the present invention maintains excellent heat response characteristics, is resettable, and will function under fail-safe conditions, that is, either in response to a preselected increase in ambient temperature, or in response to the remote activation of the mechanical activation means. If a malfunction occurs in one of the alternate activation means, the other activation means is free to function.

7 Claims, 2 Drawing Figures

RESETTABLE, HEAT ACTUATABLE FIRE LINK

BACKGROUND OF THE INVENTION

The present invention is generally an improvement relating to the heat actuated releasing device as described in my prior U.S. Pat. Nos. 3,725,972, entitled "Fire Link and Method of Actuating Same;" and 3,889,314, entitled "Heat Actuated Link."

In each of the aforementioned patents, resettable heat actuated releasing devices are described. One of these devices, for example, incorporates remotely controlled heating means for electrically heating the bimetallic element to actuate the device. In certain installations electrical heating of links may not be preferred either due to the use of a pneumatic or hydraulic system in other portions of the installation and/or due to the existence of an operating environment wherein electrical heating is not economical. In each of the links described in the aforementioned patents, the sole source of movement for releasing the releasable member is the heat induced distortion of the bimetallic element with respect to the base or mounting element. Obviously, in the lack of heat (whether produced by a rise in the ambient temperature or by auxiliary heating means) neither of the aforementioned fire links will open spontaneously.

SUMMARY OF THE PRESENT INVENTION

The present invention relates to an improved releasing device which is responsive either to a preselected increase in the ambient temperature around that link or to remote activation through mechanical activation means. In particular, a link is provided having a releasable member and gripping means for engaging the releasable member in the normal position and for releasing the releasable member in the activated position. This gripping means comprises heat responsive means for causing the gripping means to move to the normal position in response to a preselected ambient temperature and to move to the activated position in response to a preselected increase in that ambient temperature. In the preferred embodiment, this heat responsive means is a bimetallic element which may have either a substantially straight or serpentine configuration as described in each of the aforementioned patents, U.S. Pat. Nos. 3,725,972 and 3,889,314, which patents are hereby incorporated as if fully set forth herein.

Mechanical activation means for remotely releasing the releasable member is also provided which does not interfere with the function of the aforementioned heat responsive means. When in a first withdrawn position, the mechanical activation means allows the gripping means to move freely between the normal and the activated positions as aforesaid. Upon remote activation, this means independently causes the gripping means to release the releasable member regardless of the temperature of the bimetallic element. The mechanical activation means of the preferred embodiment comprises a force producing means and a ram. The ram need be powered only towards the bimetallic element, that is, to cause a separation of the bimetallic element from the mounting element. Upon deactivation, the normal function of the bimetallic element will cause the return of the ram to the withdrawn position. In the event that the bimetallic element is unable to return the ram to the withdrawn position, the link cannot be reset, thereby acting as a safety feature which requires that further attention be given either to the force producing means and/or to the bimetallic element prior to its further use.

In order to maintain excellent heat response characteristics, the force producing means is disposed on the opposite side of the mounting element from the bimetallic element and is spaced away from the mounting element by a bracket means which creates an air channel therebetween. Only a small portion of the ram extends from the force producing means through the aforementioned air channel and through a void defined in the mounting element. The surface of the bimetallic element which faces the mounting element is engaged by said ram at a single point. The result is a minimum interference between the heat responsive means and the mechanical activation means.

Accordingly, a primary object of the present invention is the provision of a heat actuatable releasing device which is also capable of remote mechanical activation. A further object of the present invention is the provision of a releasing device having a heat responsive means and mechanical activation means which are so interrelated that neither's function is interfered with by the failure of the other. Another object of the present invention is the provision of a remotely activatable releasing device ideally suited for use in a "dirty" environment. These and other objects of the present invention will become apparent from the following more detailed description.

DETAILED DESCRIPTION OF THE DRAWINGS

Figure 1:
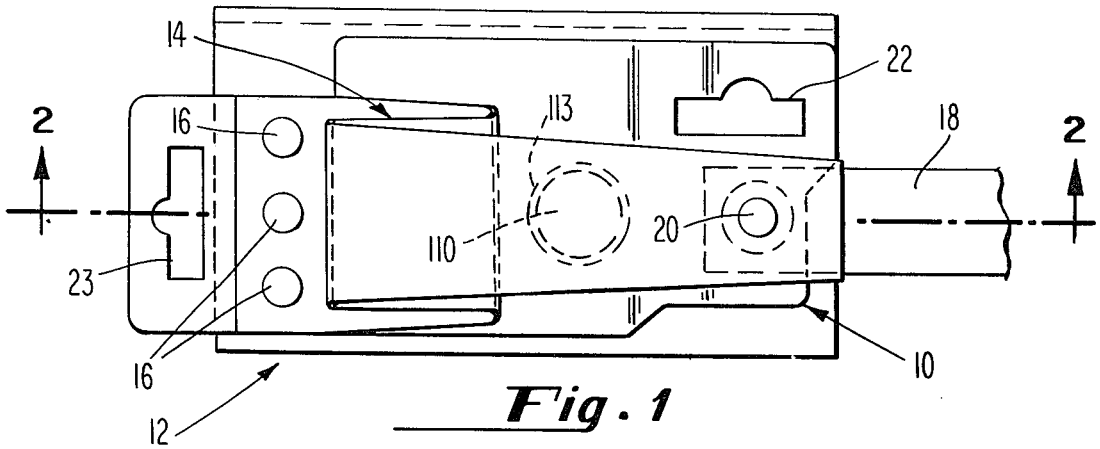
FIG. 1 is a top view of a preferred embodiment of the present invention, characterized by a serpentine bimetallic element.

Although specific forms of the invention have been selected for illustration in the drawings, and the following description is drawn in specific terms for the purpose of describing these forms of the invention, this description is not intended to limit the scope of the invention which is defined in the appended claims.

FIG. 1 is a top view of the preferred embodiment link of the present invention, designated generally 12. The link 12 generally comprises a releasable member or pawl 18, a mounting element designated generally 10, a bimetallic element designated generally 14, and a mechanical activation means designated generally 15. The mounting element, designated generally 10, and the bimetallic element; designated generally 14, together comprise a gripping means for normally engaging the releasable member 18 and for releasing the releasable member in response to an increase in ambient temperature. The link is designed for use in automatically actuated equipment forming a part of fire fighting systems. The embodiment shown in FIG. 1 is intended to respond to an increase in ambient temperature by allowing the separation of the releasable member 18 from the remainder of the link 12.

As shown in FIG. 1, various attachment means are provided to ensure flexibility in installation. The mounting element 10 of the link of the present invention has two attachment sites 22 and 23 for cables, chains or straps. Further means for attachment are normally positioned at the far end of the releasable member, which attachment means are not shown in the drawings.

Figure 2:
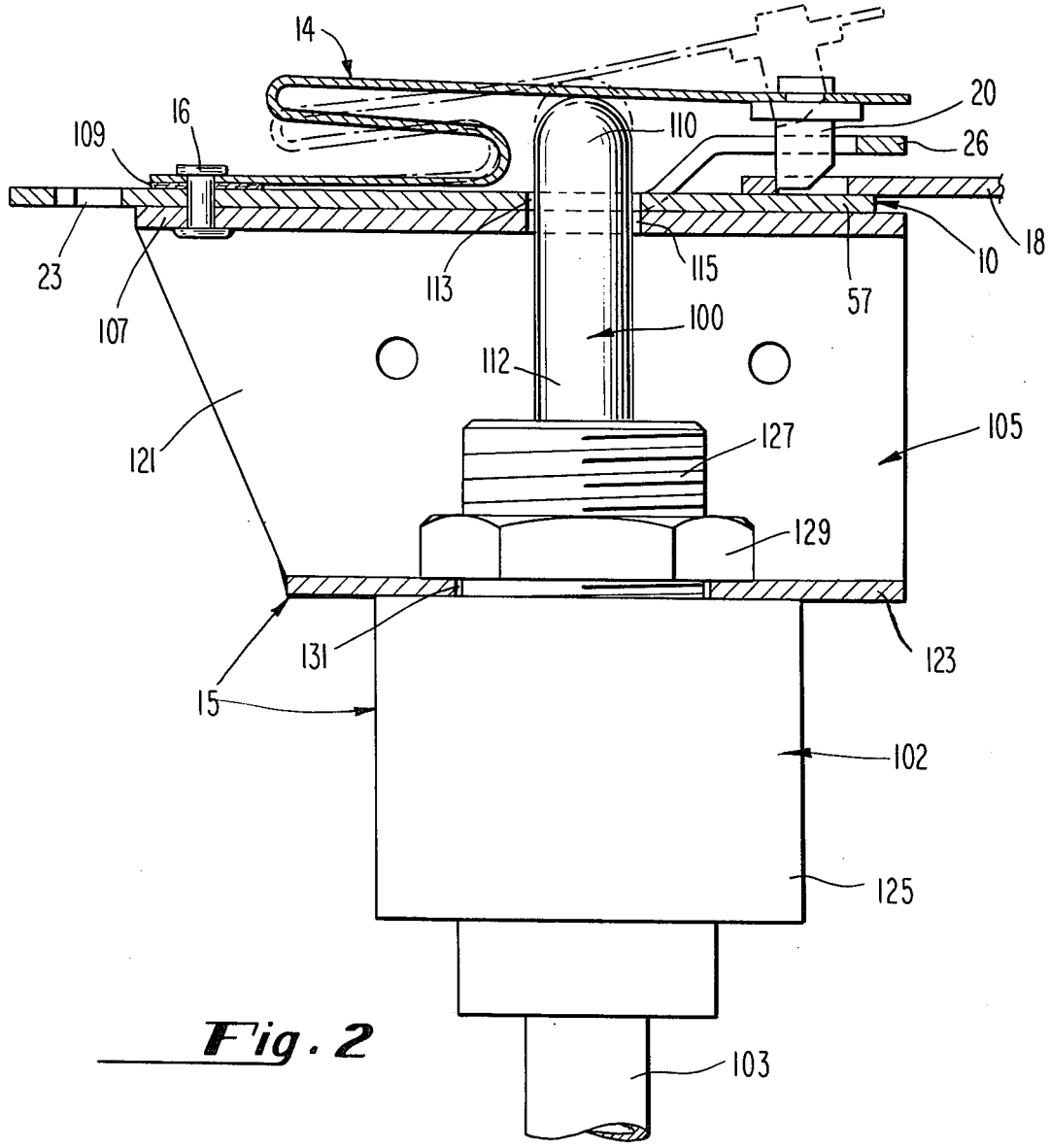
FIG. 2 is an enlarged cross-section of the embodiment shown in FIG. 1 taken as indicated by the line and arrows 2—2 in FIG. 1.

Referring now to FIG. 2, the interrelationship between the mounting element 10, the bimetallic element 14, and the pawl 18 is demonstrated, together with the interrelationship between each of the aforementioned elements and the mechanical activation means, designated generally 15. The mounting element 10 is substantially planar and is attached to the bimetallic element 14 by fastening means 16 which are rivets, or other metal fasteners. The end of the mounting element 10 which engages the pawl 18 is differentiated into an offset portion 26 and a striker portion 57.

The bimetallic element is shown attached by means of the aforementioned fastening means 16 to the mounting element 10 near the end of the mounting element which is remote from its interconnection with the pawl or releasable member 18. In its normal position, the bimetallic element is disposed so that pin 20 will extend through a void defined in the offset portion 26 of the mounting element 10, and then through a hole in the releasable portion 18, terminating in an end which is close to or touching the striker portion 57. The end of the pin 20 which is remote from the bimetallic element is beveled to allow the releasable member to be manually inserted. When the link is in its normal (unheated) position, engagement of the releasable member 18 is effected by pushing the releasable member 18 against the bevel of the pin 20 thereby forcing the pin 20 away from the striker portion 57 and allowing the pawl 18 to slide into position in which the hole in the pawl aligns with the pin and is pierced thereby as pin 20 returns to its normal position.

The bimetallic element designated generally 14 should be so formed that it assumes the normal position shown in the solid lines in FIG. 2 when exposed to the ambient temperature of its expected installation. The bimetallic element itself is made of a conventional bimetallic material selected for its characteristic strength, elastic memory and ability to resist fatique which bent to the desired configuration. The bimetallic element is made of two flat strips of dissimilar material adhered together in any well known manner. Bimetallic elements are commonly used in thermostats and the like. See for example the bimetallic fire links disclosed in U.S. Pat. Nos. 725,972 and 3,889,314.

The operation of the gripping means is selectively gripping or releasing the releasable member 18 in response to a preselected increase in the ambient temperature around the device is quite simple. As seen in FIG. 2, the configuration of the bimetallic element 14 exposes a large surface area to the ambient air which surrounds the link, which surface area is substantially uninterferred with by the mechanical activation means 15. As the temperature of the air around the link rises, the bimetallic element is heated, causing the element to assume the configuration shown in phantom.

Although the serpentine configuration of the bimetallic element 14 is illustrated in the drawings, in an alternate embodiment the bimetallic element may be configured as illustrated in my prior issued U.S. Pat. No. 3,725,972.

The mechanical activation means of the present invention comprises a force producing means 102 which may be a pneumatic or hydraulic cylinder (in an electrical embodiment, a solenoid) and a ram 100. The ram 100 may be a piston rod or other similar rod which is acted upon by the force producing means 102 to selectively separate the mounting element designated generally 10 from the bimetallic element designated generally 14, thereby releasing the releasable member 18 as shown in phantom. The tip of ram 100 is rounded to minimize contact and wear between the ram 100 and the undersurface of the tip portion of bimetallic element 14. In the event that the link of the present invention was activated by heat only (the force producing means was not independently activated to move ram 100 into the position shown in phantom in FIG. 2), the ram would remain as shown in the solid position. Alternatively, if either heat and the force producing means activated the link or alternatively, if the force producing means were the sole source of activation of the link, a position of the ram as shown in phantom in FIG. 2 would be assumed and retained as long as pressurization through tube 103 or other activation means continued to apply a force to the ram. Although a double acting cylinder may be utilized as the force producing means 102, the present invention contemplates that upon deactivation of the force producing means 102, the elastic memory of the bimetallic element 14 will cause the ram 100 to move from the phantom to the solid lined position in FIG. 2. By not substituting a double acting cylinder for the force producing means 102, a natural check on the function of the bimetallic element and the mechanical activation means occurs in that any damage which might occur during a fire or due to wear and so forth, will become immediately apparent if the ram 100 and the bimetallic element 14 do not return to the solid lined position in FIG. 2.

Since it is of great importance to maintain the heat activation characteristics of the link, an air channel is formed between the force producing means designated generally 102 and the heat responsive element of the link. If, for example, the force producing means 102 were directly mounted onto the mounting plate or mounting element designated generally 10 of the link, free flow of ambient air around the link would be interfered with and the substantially higher heat capacity of the hydraulic cylinder or solenoid might draw heat from the bimetallic element, thereby possibly inhibiting or delaying a heat activated release of the releasable member. The force producing means designated generally 102 is therefore disposed on the opposite side of the mounting element designated generally 10 from the bimetallic element 14. Furthermore, a U-shaped bracket 105 is utilized to space the force producing means apart from the mounting element, which space is spanned by the ram 100 extending therefrom. U-shaped bracket 105 may be conveniently attached to the mounting element 10 at its base 107 by rivet 16. Insulation 109 is provided between the bimetallic element 14 and the mounting element to further prevent heat transfer therebetween. Only the tip 110 of ram 100 extends into the space created between the bimetallic element 14 and the mounting element 10, access to which space is provided by voids 113 and 115 defined in mounting element 10 and base portion 107, respectively. Side portion 121 is seen to extend substantially parallel to the axis of the ram designated generally 100 to supporting portion 123 which is parallel to base portion 107. In the embodiment shown in FIG. 2 wherein the force producing means designated generally 102 is illustrated as a hydraulic cylinder having conduit means 103, cylinder portion 125, threaded portion 127, nut 129 and the aforementioned ram designated generally 100, assembly of the unit is relatively simple in that the cylinder is usually inserted through a bore 131 formed in supporting portion 123 after which nut 129 is applied down over threaded portion 127 to tightly engage the cylinder portion 125 against supporting portion 123.

It will be understood that various changes in the details, materials and arrangement of parts which have been herein described and illustrated in order to explain the nature of this invention may be made by those skilled in the art within the principle and scope of the invention as expressed in the following claims.

It will be further understood that the "Abstract of the Disclosure" set forth above is intended to provide a nonlegal technical statement of the contents of the disclosure in compliance with the Rules of Practice of the U.S. Patent and Trademark Office, and is not intended to limit the scope of the invention described and claimed herein.

I claim:

1. A resettable fire link comprising, a. a releasable member;

b. gripping means associated with said releasable member for engaging said releasable member in a normal position, and for releasing said releasable member in an actuated position, said gripping means comprising at least one mounting element and heat responsive means for causing said gripping means to move to the normal position in response to a preselected ambient temperature and for causing said gripping means to move to the actuated position in response to a preselected increase in said ambient temperature; and c. mechanical activation means connected to said mounting element for movement from a first withdrawn to a second extended position, said mechanical activation means in said first withdrawn position allowing said gripping means to move between said normal and said activated position and for causing said gripping means to move to the activated position in response to movement of said mechanical activation means to said second extended position.

2. The invention of claim 1 wherein said heat responsive means moves said mechanical activation means from the extended to the withdrawn position in response to said ambient temperature and the deactivation of said mechanical activation means.

3. The invention of claim 1 wherein said gripping means further comprises a mounting element and a bimetallic element, and wherein said mechanical activation means is mounted on said mounting element to selectively separate said mounting element from said bimetallic element.

4. The invention of claim 3 wherein said mechanical activation means further comprises force producing means and a ram, said force producing means being disposed on the opposite side of said mounting plate from said bimetallic element, and least a portion of said ram being disposed through a void defined in said mounting element for engagement with said gripping means.

5. The invention of claim 4 wherein said force producing means comprises a pneumatic cylinder.

6. The invention of claim 5 wherein said force producing means comprises a bracket for disposing said cylinder apart from said mounting element, whereby an air passage is created therebetween.

7. A releasing device comprising:

a. a first element;

b. a heat actuated bimetallic second element coacting with said first element to separate from said first element in response to temperature change; and c. pneumatic means connected to said first element for selectively separating said first and second elements without interfering with said separation of said elements in response to temperature change.

* * * * *